United States Patent [19]

Hilger et al.

[11] Patent Number: 5,031,255

[45] Date of Patent: Jul. 16, 1991

[54] WHIRLPOOL

[75] Inventors: Ronald O. Hilger, Elmhurst; Donald J. Kempiak, Palatine; William Kalnins, Maple Park, all of Ill.

[73] Assignee: Associated Mills, Inc.

[21] Appl. No.: 462,808

[22] Filed: Jan. 10, 1990

[51] Int. Cl.[5] ..... A61H 33/02

[52] U.S. Cl. ..... 4/542; 4/543; 4/544

[58] Field of Search ..... 4/542, 543, 544, 567, 4/568, 570, 577

[56] References Cited

U.S. PATENT DOCUMENTS

| | | | |
|---|---|---|---|
| 2,045,815 | 6/1936 | Wiesjahn | 4/577 |
| 2,756,439 | 7/1956 | Bollen | 4/577 |
| 2,836,834 | 6/1958 | Tisdall | 4/577 |
| 3,414,909 | 12/1968 | Provi et al. | 4/577 |
| 3,961,382 | 6/1976 | Peterson, Jr. | 4/544 X |
| 4,127,117 | 11/1978 | Peterson, Jr. | 4/544 X |
| 4,417,361 | 11/1983 | Smith | 4/577 |
| 4,417,568 | 11/1983 | Nozawa et al. | 4/543 X |
| 4,472,844 | 9/1984 | Mace | 4/579 |

FOREIGN PATENT DOCUMENTS

| | | | |
|---|---|---|---|
| 672063 | 10/1989 | Switzerland | 4/542 |

OTHER PUBLICATIONS

"Pollenex" Whirlpool Power Spa sales literature, published by Associated Mills, Inc., 1989, 1 page.

*Primary Examiner*—Henry J. Recla
*Assistant Examiner*—Robert M. Fetsuga
*Attorney, Agent, or Firm*—Laff Whitesel Conte & Saret

[57] ABSTRACT

A whirlpool home appliance is built into a U-shaped housing for fitting over and clamping to the side of a bath tub. A water pump is in the side of the housing which is in the bath tub in order to energize the water in the tub. An air pump is in the side of the housing which is outside the tub in order to pump air to a bubbling bath mat which fits on the bottom of a bath tub. The motor for the appliance is a reversing motor which runs in either of two directions. A one-way clutch disconnects the water pump when the bubbling air mat is used. The air pump may run all of the time since the loading of an air pump is not so great that it must be disconnected when not in use. The housing is attached to the tub by a screw which has a large area of relatively soft padding with a radially distributed flexibility so that there is no abrupt discontinuity of clamping forces. The pad avoids and prevents damage to a plastic or fiber glass bath tub when the screw tightened.

14 Claims, 2 Drawing Sheets

HOUSING
DRIVER
SHAFT
DRIVEN
B
HOUSING
OVERRUNS CLOCKWISE
SHAFT
IS STATIONARY
A

WHIRLPOOL

This invention relates to personal appliances, such as whirlpools, bubbling air bath mats, and the like.

A personal appliance is a relative low priced device which a home owner might buy for himself for his own use. This kind of appliance contrasts with a large and costly appliance that might be purchased by an institution such as a hospital, for example. The home owner uses his appliances sporadically and must store them between use. Hence, an objective of the designer of a home appliance is to provide a maximum amount of utility at a minimum cost and in a compact form. The institute would like to use the appliances almost continuously in order to recover the capital investment and to serve the needs of a maximum number of people. The institute has no storage problems since a floor space is dedicated to its facilities. Hence, the designer of institutional appliances wants to provide massive, perhaps stainless steel structures which will be useful over the indefinite future.

A whirlpool is a personal appliance which fits over and attaches to an edge of a bathtub. A pump in the whirlpool housing imparts energy into the bath water itself in order to provide a therapeutic treatment to a person who is in the water. Of course, the user does not have to have a motive of securing a therapeutic effect. Some people like to sit in energized water and enjoy the feeling of well being that they receive.

A bubbling air bath mat is a somewhat plate like device which covers most of the bottom surface of the bath tub. An air pump drives pressurized air through the mat and out a series of holes formed on and distributed over the top surface of the mat, thereby energizing the bath water with bubbling air. One example of air bubbling mats of the described type is found in U.S. Pat. No. 4,417,568. Other patents showing the state of the art are 4,290,982; 4,269,797; 4,122,846; 4,040,415; 4,008,498; 3,809,073; 3,111,686; 1,775,942; 1,699,198; 1,350,974; and German patent No. 827,391.

Heretofore, if a person wished to have both energized water and pumped air was required to buy and store two completely separate appliances, a whirlpool and a bath mat. Also, the design and purpose of some of the appliances, such as a bubbling air bath mat, have sometimes inherently required several major parts, thus increasing the storage problems. There is an especially troublesome problem if any of the many parts must be wall mounted, as when there is a safety requirement centered around electrical potentials. To be reliable, a wall mount would require screw holes which is especially objectionable when a wall is made of tile and, therefore, screw holes would have to be drilled through or between the tile.

Another problem might occur when the home appliance is clamped onto a bath tub. For example, a whirlpool is often made in the form of a somewhat inverted "U" which fits over the side of a bath tub. Then, a screw in one arm of the "U" is tightened to clamp the appliance in place. The trouble is that many modern bath tubs are made of fiberglass or other plastic material. If the conventional home appliance whirlpool screw is tightened against the side of a plastic tub, it may break or mar it.

Accordingly, an object of the invention is to provide new and novel home appliance means for and methods of energizing a body of bath water, either by pumped air or pumped water. Here, an object is to provide a multi-purpose home appliance which can be used either as a whirlpool or a bubbling air mat.

Another object of the invention is to provide a home appliance which may be installed quickly and easily, without causing any marring or disfiguring of a surface in a bath or other room.

Yet another object of the invention is to avoid possible damage to plastic bath tubs.

In keeping with an aspect of the invention, these and other objects are accomplished by providing a whirlpool type home appliance with a bidirectional type of motor. The motor may turn in one direction to pump or energize water in a tub and in an opposite direction to pressurize air that is fed to a bubbling air mat. The drive mechanism for pumping water includes a one way clutch which automatically disconnects when the direction of motor turning is reversed to pressurize air. The screw which attached the appliance to a bath tub is associated with an over sized semi-soft surface which distributes pressures against the side of the tub to prevent damage to or marring of the tub, even when it is a plastic tub.

A preferred embodiment of the invention is shown in the attached drawings, wherein.

Figure 1:
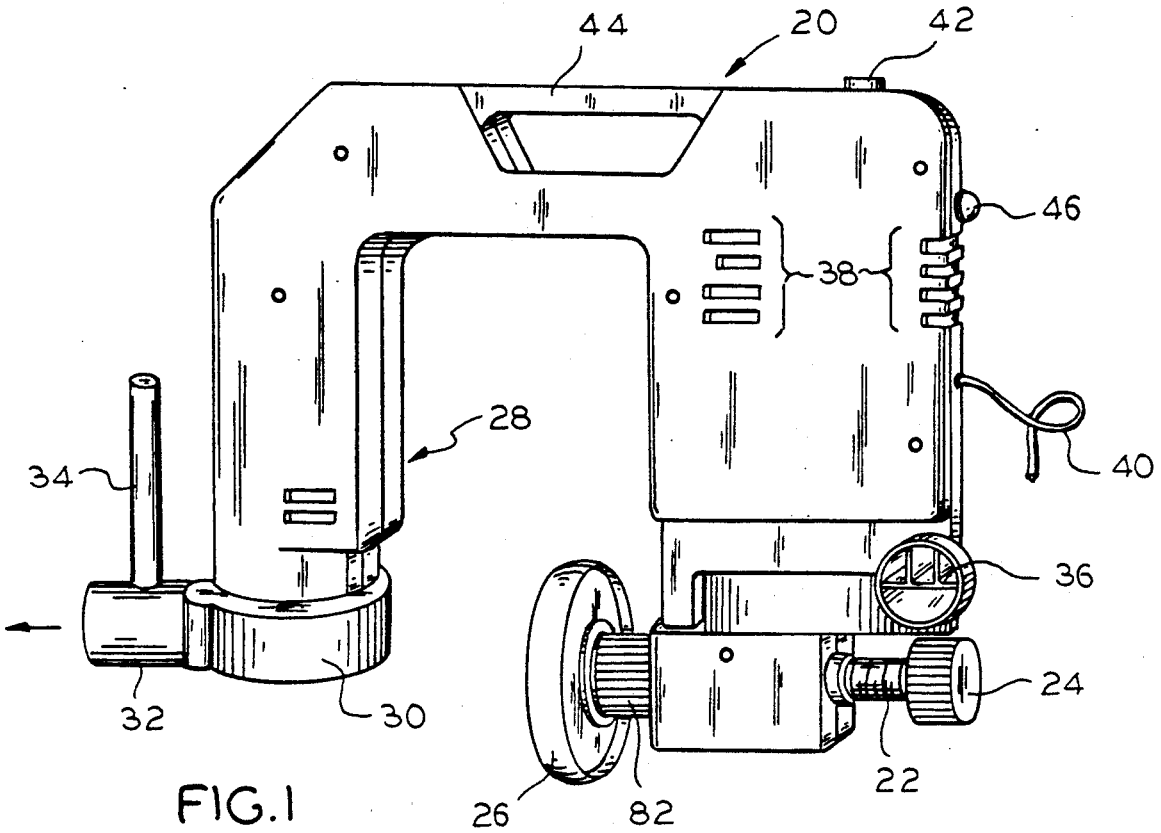
FIG. 1 is a perspective view of the inventive home appliance.

FIG. 1 shows a home appliance 20 having a somewhat inverted U-shaped appearance to fit over the side of a bath tub. The U-shape, per se, is used in prior appliances. In one arm of the U-shape, a screw 22 may be tightened or loosened by turning a handle 24 to advance or retract a pad 26 toward or away from the side of the tub. The diameter of the pad 26 is much larger than the diameter of a surface normally used in a U-shaped whirlpool appliance, such as this. The opposite side of the U-shape has a relatively large area to make contact with the side of a bath tub so that there is no danger of breaking or marring the tub.

The whirlpool also includes a water pump 30 having an outlet 32 through which an outflow water may be pumped. A pipe 34 extends upwardly above the surface of the bath water to suck air into the outflowing stream of pumped water in order to increase the turbulence within the water. An air outlet 36 provides a connector for feeding pressurized air to a bubbling air bath mat. The air for the bath mat is sucked in through a plurality of openings 38 in the whirlpool housing.

In this example, the electric power cord 40 is preferably positioned at a fairly low point in order to be remote from the water in the bath tub. A control knob 42 is preferably positioned in a spot which is awkward to reach while one is sitting in the bath tub so that the user will wish to get out of the tub before touching it. This knob 42 may be either or both an on/off switch or a timer which turns off the whirlpool after a period of time. However, with suitable water seals, the electrical components may be placed at any of a number of different suitable positions.

A handle 44 is molded into the top of the whirlpool housing for the convenience of installing, removing, and moving the appliance.

Figure 2:
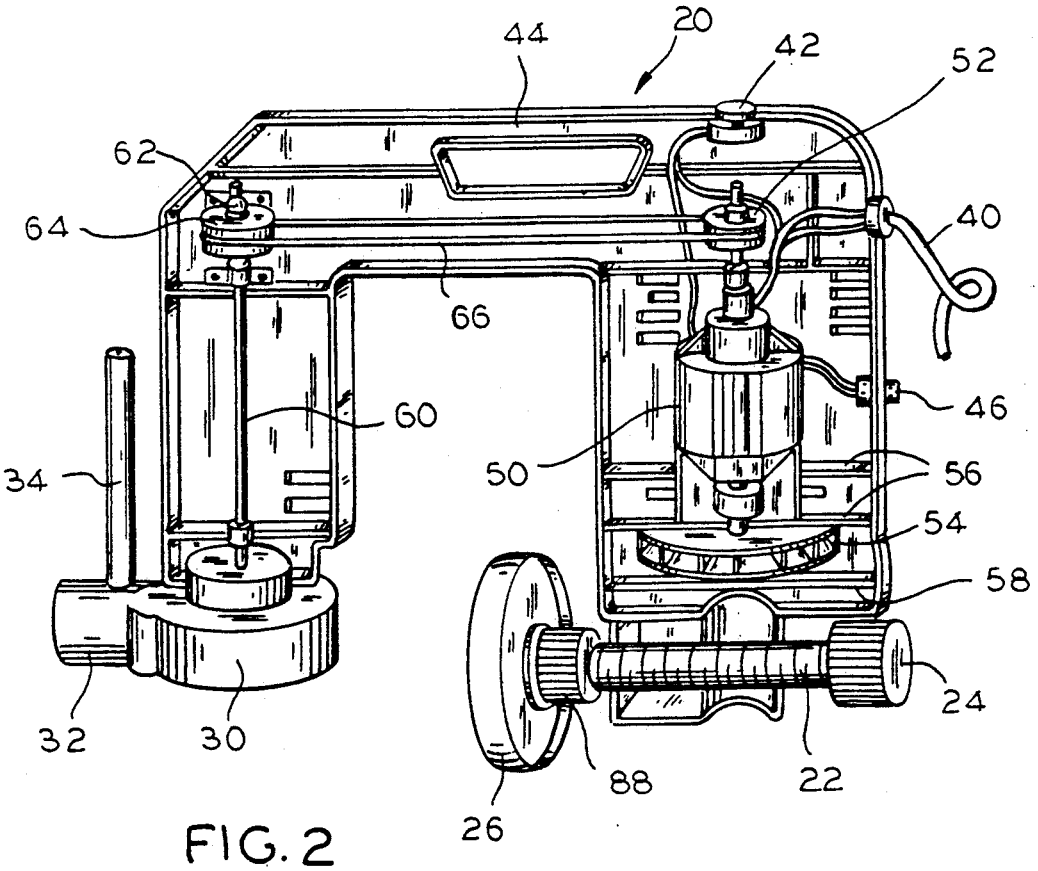
FIG. 2 is a view which is similar to the view of FIG. I, but with a side of the housing removed to reveal the internal parts.

FIG. 2 shows the inside of essentially the same whirlpool device that is seen in FIG. 1. However, in this embodiment, a water/air select switch is provided at 46 to control the direction and speed in which the motor turns. The on/off, and/or timer control switch is provided at 42. Again these controls may be placed so that the user may wish to get out of the tub before touching them. Suitably sealed switches and, perhaps, other safety devices should be provided to avoid shock hazards near the bath water.

The major assemblies in the home appliance are a vertically mounted motor 50 (FIGS. 2, 3) having a drive pulley 52 on a top end of its shaft to supply pressurized water to energize the bath water. An air pump or impeller 54 is mounted on the opposite end of the motor shaft to supply pressurized air to a bath mat. A cooling fan 55 (FIG. 3) may be provided for cooling the motor and for preventing a build up of heat within the housing. Suitable bulkheads 56, 58 are molded into the housing sides in order to keep water away from the motor.

The opposite end of the housing includes a vertically mounted, rotary shaft 60. The water pump 30 is mounted in the bottom of the housing and connected mounted to be turned by the shaft 60. The top of the shaft is connected through a one-way clutch 62 to a pulley 64. An endless belt 66 is trained over pulleys 52, 64 to transfer power from motor 50 to turn water pump 30. The one way clutch 62 is a well known, standard commercial item, one example of which is sold by Torrington, a manufacturer of bearings.

The one-way clutch is shown in FIGS. 6A, 6B, which are figures that were taken from a Torrington sales literature. That sales piece further describes the clutch as a roller clutch which turns in one direction to transmit a torque between a shaft and a clutch housing and which allows a free overrun when the torque acts in the opposite direction. When transmitting torque, either the shaft or the housing can be the input member. The various applications are generally described as indexing, backstopping or overrunning. The bearing housing has interior ramps which either seize or free roller bearings in order to control the lockup or the free run of the clutch. Stainless steel springs permit higher rates of clutch engagement. A nylon cage permits operation at higher temperatures.

Figures 3, 4, 5, 6:
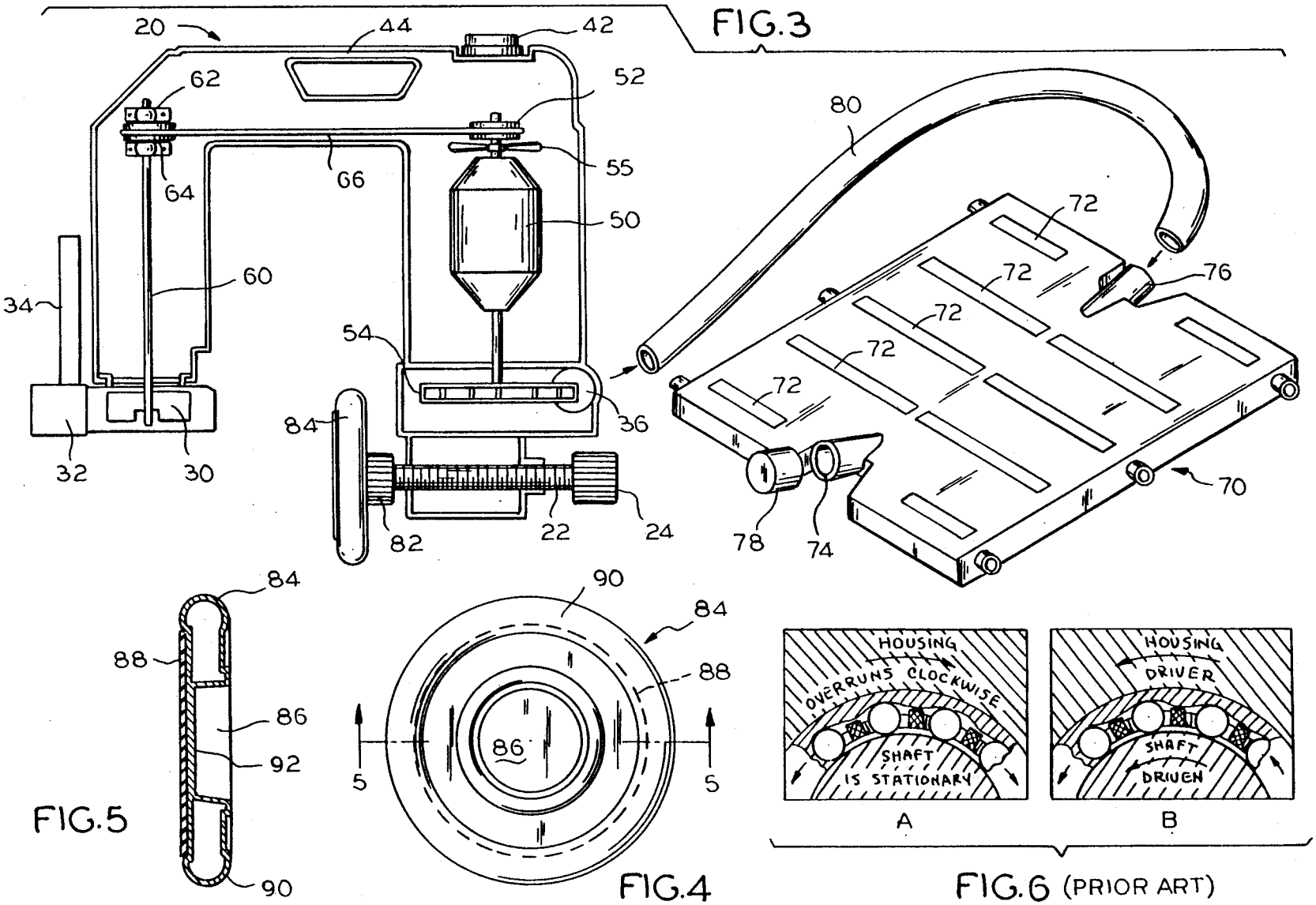
FIG.6 (PRIOR ART)
FIG. 3 is a highly simplified schematic showing of the drive train, which is useful for explaining the inventive operation.
FIG. 4 is a plan view of a pad for spreading clamping forces over a substantial area on the surface of a bath tub.
FIG. 5 is a cross sectional view taken along the line 5—5 of FIG. 4.
FIG. 6 are two cross section views taken from a manufacturer's description of a one way clutch.

The operation of the home appliance will be described with the aid of FIG. 3. When used with a bubbling air bath mat, a suitable mat 70 is placed in the bottom of a bath tub. For simplicity, FIG. 3 shows only one of three mat sections. For more information on the entire mat assembly, reference may be had to patent 4,417,568.

Two ports 74, 76 enable air to enter or leave the bath mat. A cap 78 may close either one of these ports. An air hose 80 may interconnect the other mat port and the outlet port 36 of the air pump. At the time when the mat is in use, the motor 50 is turning in a direction which causes one-way clutch 62 to disengage the water pump 30. Therefore, shaft 60 does not turn so that pump 30 is stationary to avoid loading the motor, which is a substantial load when water is being pumped. The impeller 54 always turns since the loading of air is not very substantial. Therefore, air streams through hose 80 and out of a plurality of tiny holes distributed over the surface of the mat 70, as indicated by the lines 72. Since, the air pump does not impose any substantial loading on the motor it is irrelevant whether or not air pump 54 expels any air from the output port 36 while the water pump is in operation.

When the home appliance is used as a whirlpool, neither the hose 80 nor the bubbling bath mat 70 is connected at 36 to the air pump 54. The electrical connections to motor 50 are reversed as compared to the direction of the electrical connections on bath mat usage. Thus, the motor turns in an opposite direction as compared to the direction of turning while air is being pumped. The one-way clutch 62 engages and shaft 60 turns, as does the water pump 30 affixed to the lower end thereof. As a result of the rotation of the water pump 30, water is expelled with substantial force out of the nozzle 32. The on-rushing stream of water tends to draw air through the tube 34 which projects above the surface of the bath water. Thus, the on-rushing stream of water contains a number of air bubbles.

The conventional whirlpool is held in place by a screw which has an end 82 that is approximately the diameter of the handle 24. This relatively small diameter is more than satisfactory for clamping the whirlpool onto a cast iron bath tub. However, it is liable to crack a plastic tub. Moreover, the scrubbing of end 82 against a plastic surface could mar it.

Therefore, the invention provides a relatively large cap 84 (FIGS. 4, 5) having a central socket 86 which fits with friction over the end 82 on screw 72. This cap has a stiffening disk 88 which adds greater rigidity in the center of cap 84 without decreasing the flexibility at the periphery 90 of the cap 84. The center 92 of the cap 84 (bottom of socket 86) has a relatively thick section which makes it more rigid than the area which is between the fairly rigid center and the soft edge 90. Accordingly, the end cap 84 provides a graduated increase of flexibility or reduction of stiffness as it extends outwardly in the radial direction.

The idea behind the end cap is that the clamping pressures are distributed over a wide area on the surface of the bath tub. There is no point of discontinuity where there is a very much stronger clamping pressure on one side of that discontinuity and a very much weaker clamping pressure on the other side of the point.

Those who are skilled in the art will readily perceive how to modify the invention. Therefore, the appended claims are to be construed to cover all equivalent structures which fall within the true scope and spirit of the invention.

What is claimed:

1. A home appliance comprising a generally U-shaped housing having a size and a shape which fits over a side of a bath tub, bidirectional motor means in said housing for imparting a turning force, water pump means in one arm of said U-shape and operating responsive to said bidirectional means turning in one direction for imparting energy into water inside said bath tub, air pump means in the other arm of said U-shape and operating responsive to said bidirectional means turning in at least an opposite direction for providing a source of pressurized air, a one-way clutch means interposed between said bidirectional means and at least said water pump means for selectively turning said water pump means for effective operation when said motor turns in said one direction, and means responsive to said pressurized air for bubbling air through said water in said bath tub.

2. The home appliance of claim 1 and an air hose, an air bubbling bath mat, and said means for bubbling said pressurized air through said water comprising said bubbling air bath mat coupled through said air hose to said source of pressurized air.

3. The home appliance of claim 1 and means associated with one of said arms for clamping said U-shaped housing to said side of said bath tub, said clamping means comprising a screw terminating in a large pad for substantially distributing clamping forces across a large area of said tub.

4. The home appliance of claim 3 wherein the flexibility of said large pad is radially graduated and is distributed over said large area so that there is substantially no abrupt discontinuity of said clamping forces across the surfaces of said pad.

5. The home appliance of claim 1 wherein said bidirectional means is an electrical motor with a shaft vertically mounted in said other arm and having a first pulley on one end of said shaft said pulley being at a height on said shaft which is in line with the part of said U-shaped housing which joins said two arms, a vertical shaft rotatably mounted in said one arm and having a second pulley aligned with said first pulley, and a drive belt trained over said two pulleys and extending through said part of said housing which joins said two arms, said one-way clutch means being associated with at least one of said pulleys for effectively connecting-/disconnecting said water pump means to said drive belt depending upon the direction in which said motor turns.

6. The home appliance of claim 5 wherein said air pump means comprises an impeller attached to the other end of said shaft of said motor.

7. The home appliance of claim 6 wherein said one way clutch is a roller bearing having a race wherein said roller bearings seize when turned in one direction and roll freely when turned in another direction.

8. A home appliance comprising a whirlpool having a housing shaped and proportion for clamping on a bath tub, a bubbling air bath mat for fitting on the bottom of a bath tub in order to bubble air through water in said bath tub, said housing including separate means for pumping water and air respectively, means for optionally coupling said mat to receive pressurized air from said means for pumping air, and means for selectively and separately enabling said pumping means either for pumping and energizing said water in said bath tub or for bubbling air only through said bath mat.

9. The home appliance of claim 8 wherein said means for clamping said housing on said bath tub comprises a relatively large pad for applying clamping pressure over a large contact area, said pad being substantially free of any abrupt discontinuities of flexibility extending radially across the large contact area where said pad engaged said bath tub and applies said clamping pressure thereto.

10. A home appliance comprising a whirlpool having a housing shaped and proportioned for clamping on a bath tub, a bubbling air bath mat for fitting on the bottom of a bath tub in order to bubble air through water in said bath tub, said housing including separate means for pumping water and air respectively, means for optionally coupling said mat to receive pressurized air from said means for pumping air, a bidirectional motor coupled to both said separate water and air pumping means said motor being coupled to one of said water and air pumping means via a one way clutch means for selectively enabling a pumping of either water or air depending upon the direction in which said motor is turning, and switch means for selecting the direction in which said motor turns and enabling said pumping means for either pumping and energizing said water in said bath tub or bubbling air through said bath mat.

11. The home appliance of claim 10 wherein said one-way clutch is interposed between said motor and said means for pumping water whereby said water pump may be engaged or disengaged, said air pumping means operating substantially continuously as long as said motor is turning in either direction.

12. A home appliance comprising means for energizing water for imparting a body massaging action, means for bubbling air through said water, a common driving means for selectively and exclusively operating only one of either said water energizing means or said air bubbling means, and means for operating said common drive means in response to a selection of either said water energizing means said bubbling air means.

13. A home appliance comprising means for energizing water for imparting a body massaging action, means for bubbling air through said water, a bidirectional motor for supplying a force to energize said water responsive to a turning of said motor in one direction, means for supplying pressurized air for said bubbling means responsive to a turning of said motor in at least an opposite direction, means for selecting between energizing said water and said means for bubbling air comprising means for selecting the direction of turning said motor, and a one-way clutch means between said motor and said means for energizing said water.

14. The home appliance of claim 13 wherein said means for bubbling air comprises a bath mat and an air hose for optionally coupling said appliance to said bath mat.

* * * * *